US011627843B2

(12) United States Patent
Biesinger et al.

(10) Patent No.: US 11,627,843 B2
(45) Date of Patent: Apr. 18, 2023

(54) WASHING CONTAINER

(71) Applicant: Munchkin, Inc., Van Nuys, CA (US)

(72) Inventors: Quinn Michael Biesinger, Los Angeles, CA (US); Thomas E. Birkert, West Hills, CA (US)

(73) Assignee: MUNCHKIN, INC., Van Nuys, CA (US)

( * ) Notice: Subject to any disclaimer, the term of this patent is extended or adjusted under 35 U.S.C. 154(b) by 0 days.

(21) Appl. No.: 16/785,422

(22) Filed: Feb. 7, 2020

(65) Prior Publication Data

US 2020/0253427 A1 Aug. 13, 2020

Related U.S. Application Data

(60) Provisional application No. 62/802,695, filed on Feb. 7, 2019.

(51) Int. Cl.
*A47K 3/12* (2006.01)

(52) U.S. Cl.
CPC ..... *A47K 3/127* (2013.01)

(58) Field of Classification Search
CPC ..... A47K 3/127; A47K 3/024
USPC ..... 4/572.1
See application file for complete search history.

(56) References Cited

U.S. PATENT DOCUMENTS

| | | | | | |
|---|---|---|---|---|---|
| 2,281,629 | A * | 5/1942 | Snow | A47D 13/08 | 5/655 |
| D221,768 | S * | 9/1971 | Savedra | D23/278 | |
| 5,276,926 | A * | 1/1994 | Lopez | A47K 3/024 | 4/575.1 |
| 5,963,993 | A * | 10/1999 | Dunn | A47K 3/127 | 4/572.1 |
| 6,989,224 | B2 * | 1/2006 | Adams | G03F 7/0392 | 430/270.1 |
| D694,867 | S * | 12/2013 | Quigley | D23/277 | |
| D724,707 | S * | 3/2015 | Murphy | D23/278 | |
| 10,966,576 | B2 * | 4/2021 | Denton | A47K 3/064 | |
| 2003/0070219 | A1 | 4/2003 | Lopes | | |
| 2006/0143819 | A1 * | 7/2006 | Davis | A47K 3/024 | 4/572.1 |
| 2011/0083261 | A1 * | 4/2011 | Goergen | A47K 3/127 | 4/572.1 |

FOREIGN PATENT DOCUMENTS

| | | | | |
|---|---|---|---|---|
| AU | 542759 B3 | | 5/1985 | |
| GB | 2193887 A | * | 2/1988 | A47K 3/024 |
| GB | 2473638 B | * | 5/2014 | A47K 3/024 |
| KR | 20140005530 | | 10/2014 | |

OTHER PUBLICATIONS

International Search Report, Search History, and Written Opinion for PCT/US2020/017334, dated Apr. 24, 2020. (pp. 12).
European Search Report and Written Opinion dated Sep. 9, 2022 (pp. 7).

* cited by examiner

*Primary Examiner* — Christine J Skubinna
(74) *Attorney, Agent, or Firm* — Robert Z. Evora, Esq.

(57) ABSTRACT

A container is disclosed for soaking and washing a toddler, and includes an asymmetric hump and a resilient mushroom-shaped plug.

18 Claims, 10 Drawing Sheets

WASHING CONTAINER

CROSS REFERENCE TO RELATED APPLICATIONS

This application claims priority to U.S. Provisional Patent Application Ser. No. 62/802,695, filed Feb. 7, 2019; the content of which is hereby incorporated by reference herein in its entirety into this disclosure.

TECHNICAL FIELD

The subject disclosure relates to containers for soaking and washing an infant, small child, or animal.

BACKGROUND

Routinely and properly cleaning an infant is one of the more challenging and stressful responsibilities that a parent has. Because the infant usually is unable to sit up by herself, at all or for an extended period of time, the parent is usually forced to use a sink or other container that is not intended or designed to hold an infant. Placing the infant in a sink is also quite dangerous because the infant can fall over into the water or slip on her bottom so that her face or mouth/nose becomes submerged in the water. Since a typical household sink is not designed to wash an infant, the environment in and around the sink may contain harmful bacteria, or have nearby dangerous obstacles for an infant, including a faucet with sharp edges or a hot water controller. Further, the sink may not be clean or properly coated to prevent the infant from any harmful exposures when in contact.

Thus, there is a need for a container which is portable, easy to use, easy to drain, easy to clean, and has a built-in design to support an infant.

SUMMARY OF THE SUBJECT DISCLOSURE

The present subject disclosure presents a simplified summary of the subject disclosure in order to provide a basic understanding of some aspects thereof. This summary is not an extensive overview of the various embodiments of the subject disclosure. It is intended to neither identify key or critical elements of the subject disclosure nor delineate any scope thereof. The sole purpose of the subject summary is to present some concepts in a simplified form as a prelude to the more detailed description that is presented hereinafter.

While various aspects, features, or advantages of the subject disclosure are illustrated in reference to washing containers, such aspects and features also can be exploited in various other container configurations.

To the accomplishment of the foregoing and related ends, the subject disclosure, then, comprises the features hereinafter fully described. The following description and the annexed drawings set forth in detail certain illustrative aspects of one or more embodiments of the disclosure. However, these aspects are indicative of but a few of the various ways in which the principles of the subject disclosure may be employed. Other aspects, advantages and novel features of the subject disclosure will become apparent from the following detailed description of various example embodiments of the subject disclosure when considered in conjunction with the drawings.

In one exemplary embodiment, the present subject disclosure is a container. The container includes a base portion; a wall portion positioned on the base portion and having a back portion; a hump positioned on the base portion; and a resilient plug positioned within a plug aperture in the base portion.

In another exemplary embodiment, the present subject disclosure is a container. The container includes a base portion; a wall portion positioned on the base portion and having a back portion; an asymmetric hump positioned on the base portion; and a plug positioned within a plug aperture in the base portion, wherein the plug is mushroom-shaped with a resilient top portion that covers drain apertures in the base portion.

In yet another exemplary embodiment, the present subject disclosure is a container. The container includes a base portion; a wall portion positioned on the base portion and having a back portion; an asymmetric hump positioned on the base portion, wherein the hump divides the base portion into two open chamber portions, a first open chamber portion positioned between the hump and the back portion, and a second open chamber portion positioned between the hump and a side opposite of the back portion; and a plug positioned within a plug aperture in the base portion, wherein the plug is mushroom-shaped with a resilient top portion that covers drain apertures in the base portion.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1A:
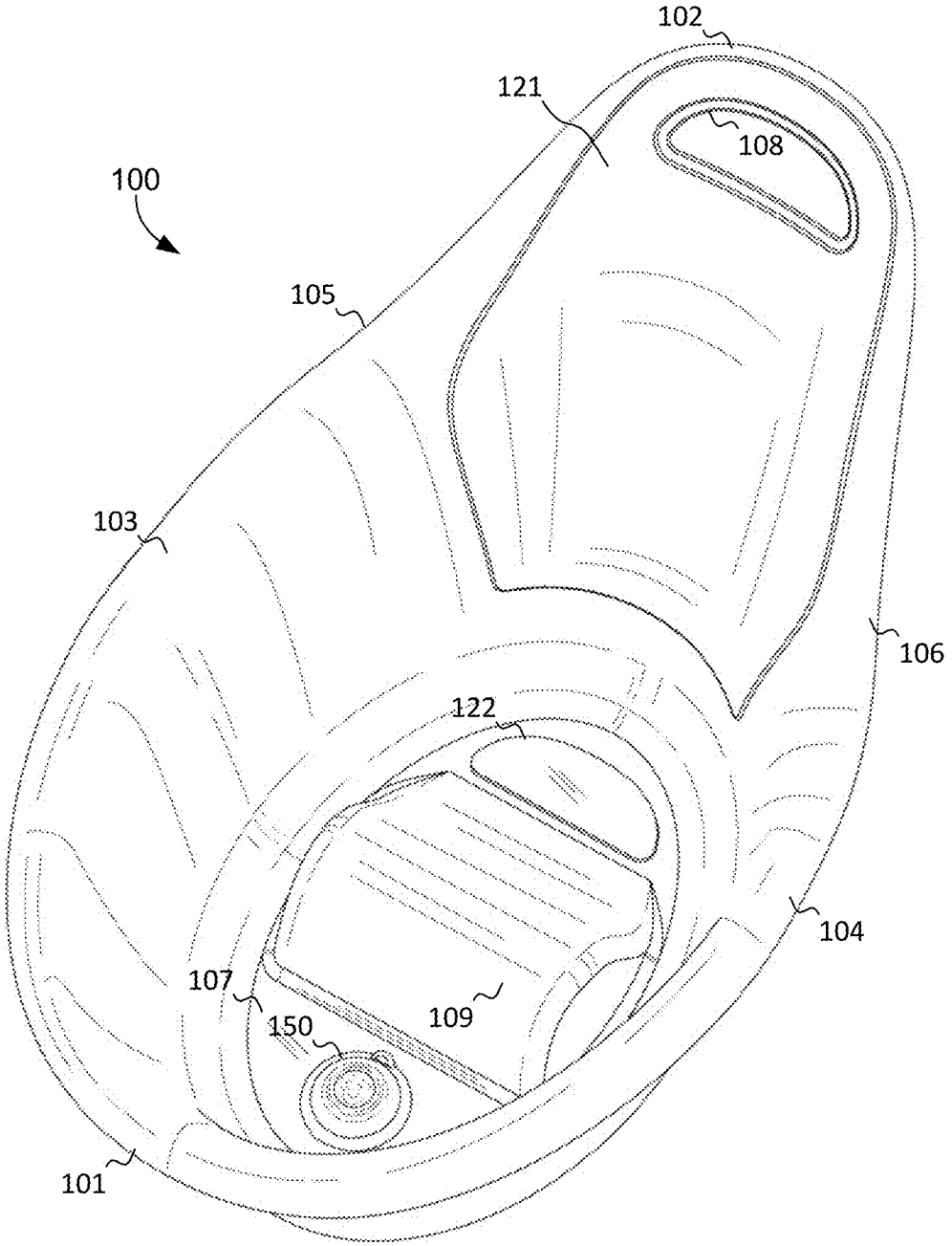
FIG. 1A is a front perspective view of a container with plug and support padding, according to an exemplary embodiment of the present subject disclosure.

Particular embodiments of the present subject disclosure will now be described in greater detail with reference to the figures.

The subject disclosure is described with reference to the drawings, wherein like reference numerals are used to refer to like elements throughout. In the following description, for purposes of explanation, numerous specific details are set forth in order to provide a thorough understanding of the present disclosure. It may be evident, however, that the present disclosure may be practiced without these specific details.

Various exemplary embodiments of the subject disclosure are presented throughout the figures. Multiple perspective views of a container according to an exemplary embodiment of the present subject disclosure are presented in FIGS. 1-6. A detailed view of a plug according to the present disclosure is presented in FIGS. 7-9. A detailed cross-sectional view of a plug within a container is presented in FIG. 10.

As shown in FIG. 1A and throughout the figures, an exemplary container 100 according to the present subject disclosure is generally of a teardrop shape (as shown in top views FIGS. 4A and 4B) with a front portion 101, a back portion 102, a right side portion 103 (with respect to a sitting baby), and a left side portion 104 (with respect to a sitting baby). The back portion 102 is higher than the front portion 101 or side portions 103, 104 and includes an embedded handle 108 for convenient transport and/or storage of the container 100. This high back portion 102 design allows the container to be easily handled and transported, placed, or hung on the wall, as need be. The right side portion 103 and left side portion 104 of the container 100 are lower than the back area 102 such that a sitting infant can rest her elbows and arms on the upper side portions 103/104 of the outer edges of the container while resting her back against the back portion 114.

The outer edges of the right side portion 103 and left side portion 104 are curved outwardly to serve as a convenient grip for a parent to transport the container. The right side portion 103 and left side portion 104 are ergonomically shaped to serve as a grip for an infant to hold herself within the container. The ergonomic curve of the right side portion 103 and left side portion 104 is gradual with no curve at all in the back portion 102 and eventually transitioning to a curve in the right transition side 105 and left transition side 106. As shown best in FIGS. 3A-3B, the front edge 101 may have the most curve, allowing an easy and ergonomic grip for a parent to safely pull the container 100 forward or push it backward or otherwise adjust its position on a counter, as needed, particularly when the infant is inside the container 100.

Referring to FIGS. 1, 4, and 6, the interior of the container 100 contains a central hump 109 that is ergonomically designed to divide the bottom portion of the container 100 into two open chamber portions which are not necessarily equal in size and shape. The first open chamber portion 112 accommodates an infant's bottom and is positioned adjacent the back side 114 of the container 100. The second open chamber portion 113 accommodates an infant's feet and is positioned adjacent the front side 115 of the container 100.

The central hump 109 acts as a barrier and separates the first open chamber portion 112 and the second open chamber portion 113. The hump 109 may be asymmetrical in that it has a more concave side 110 facing the first open chamber portion 112 and a more convex side 111 facing the second open chamber portion 113 to allow ample room for the resilient plug 150 to open and close easily. The concave portion 110 is designed to gently accommodate the infant's bottom and back part of her thigh as she sits within the first open chamber portion 112. The inside of the infant's knees are bent over the top of the central hump 109, and her lower legs and feet are generally within the second open chamber portion 113.

A plug 150 is positioned in the second open chamber portion 113 so as to direct all waste fluid away from the baby and out of the container 100 when the plug is opened, which will be described in detail below. Two fluid channels 119 (see FIG. 4) adjacent both outer edges of the central hump 109 direct fluid from the first open chamber portion 112 to the second open chamber portion 113. These channels 119 are on the sides of the central hump 109 and allow for direct fluid contact between the first open chamber portion 112 and the second open chamber portion 113, even when the fluid level is very low. In other words, the central hump 109 does not act as a fluid separating wall between the first open chamber portion 112 and the second open chamber portion 113.

The plug 150 has a soft, resilient top portion, as will be described in further detail with respect to FIGS. 7-10, and will not harm a baby's feet which are positioned in the second open chamber portion 113 and likely to be rested on the top surface of the plug 150. The position of the plug 150 within the second open chamber portion 113 makes it convenient for a parent to open the plug 150 by simply moving the baby's foot aside, as opposed to under the baby's bottom in the first open chamber portion 112, which would be more difficult to open and close. The positioning of the plug 150 in the second open chamber portion 113 also prevents the drain holes 117 from causing a vacuum during fluid outflow that could hurt an infant's sensitive skin and bottom portion.

Figure 4A:
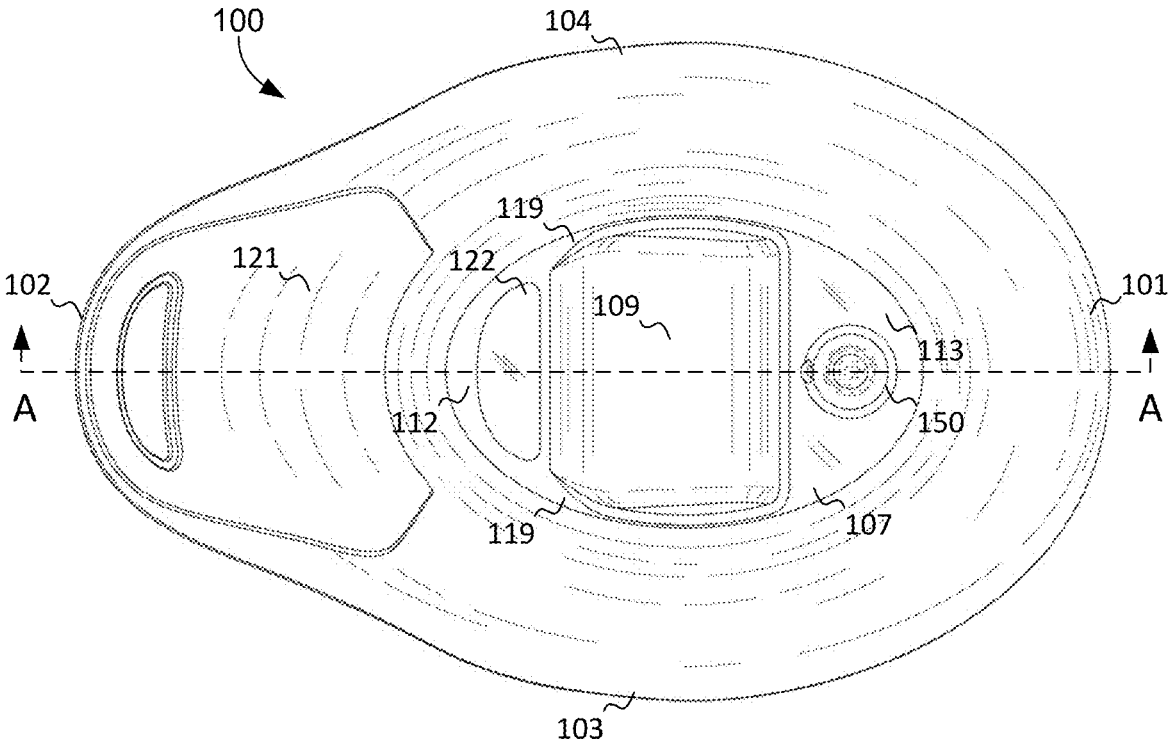
FIG. 4A is a top view of a container with plug and support padding, according to an exemplary embodiment of the present subject disclosure.
Figure 4B:
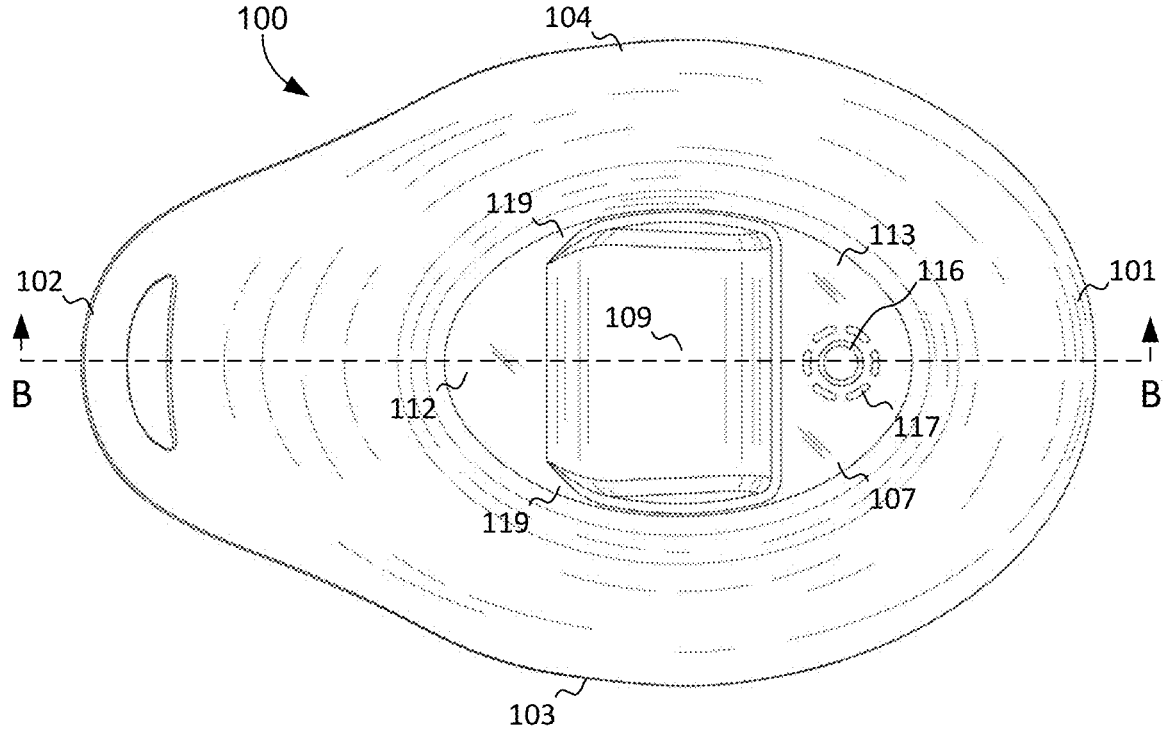
FIG. 4B is a top view of a container without the plug and support padding, according to an exemplary embodiment of the present subject disclosure.
Figure 5A:
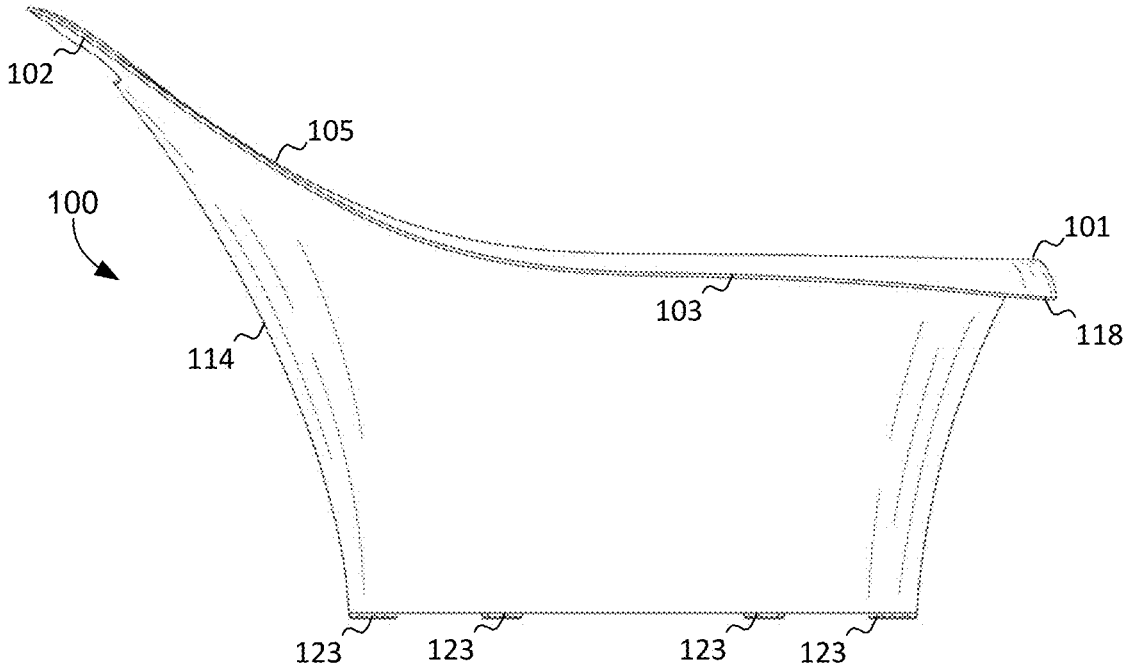
FIG. 5A is a side view of a container with leg supports, according to an exemplary embodiment of the present subject disclosure.
Figure 5B:
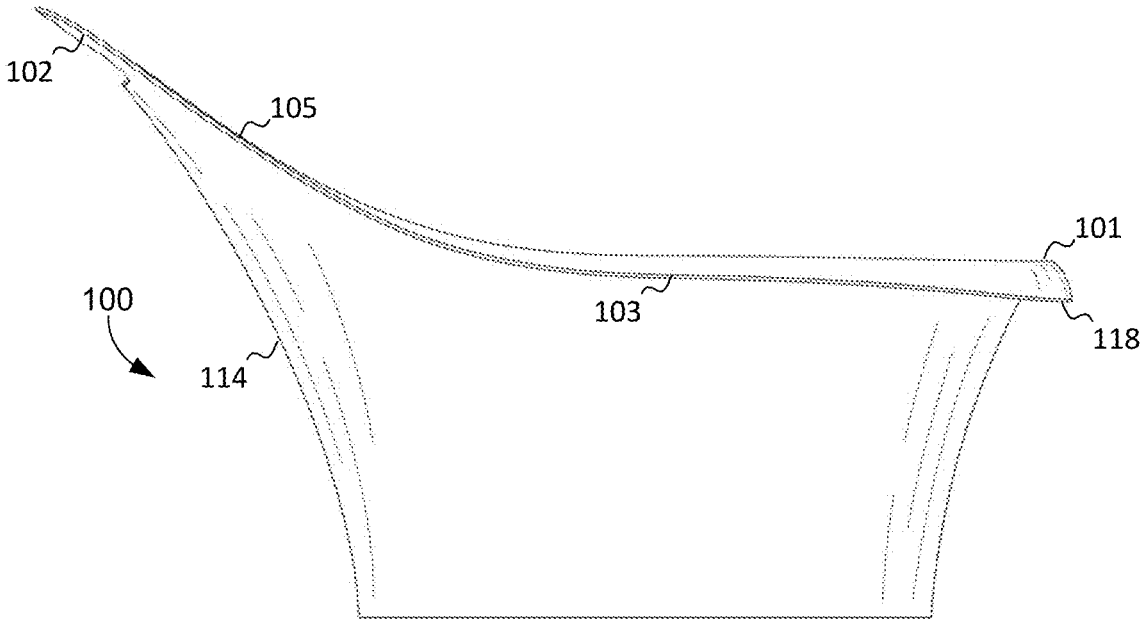
FIG. 5B is a side view of a container without the leg supports, according to an exemplary embodiment of the present subject disclosure.
Figure 6A:
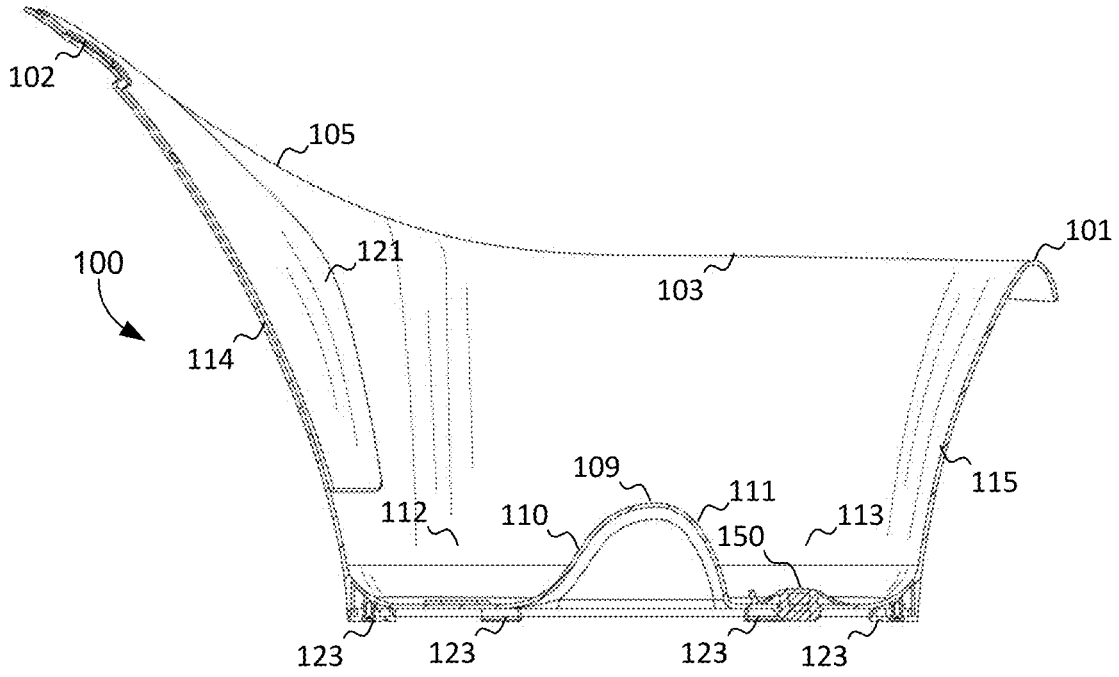
FIG. 6A is a side cross-sectional view of a container with plug, support padding, and leg supports, according to an exemplary embodiment of the present subject disclosure.
Figure 6B:
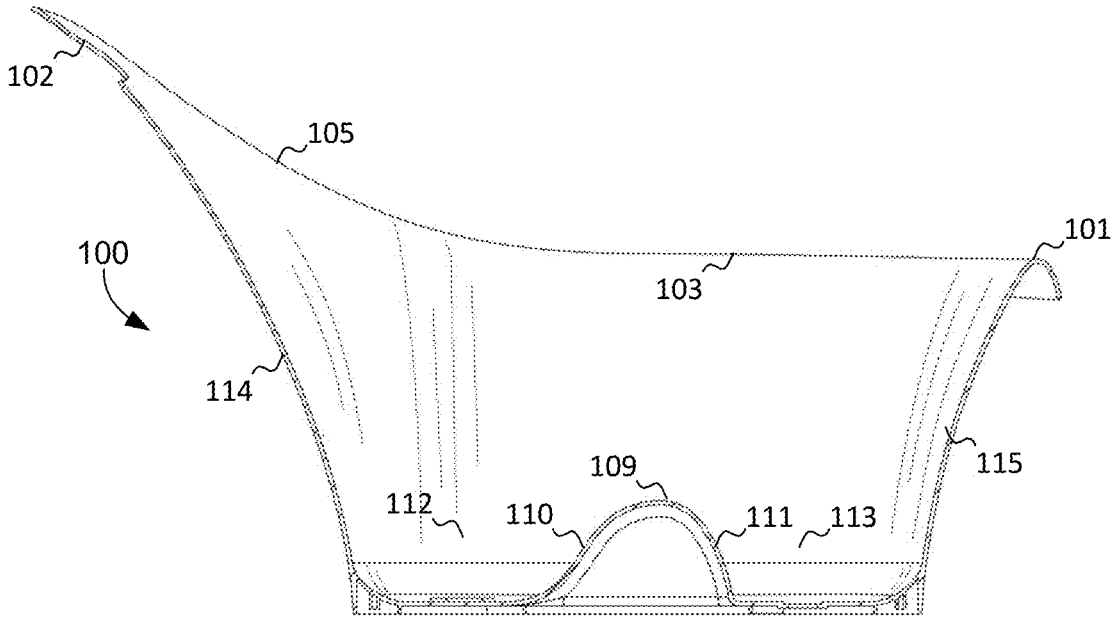
FIG. 6B is a side cross-sectional view of a container without the plug, support padding, and leg supports, according to an exemplary embodiment of the present subject disclosure.

Reference is made now to FIGS. 5A and 5B, which are right side views of the container 100, and FIGS. 6A and 6B which are right side cross-sectional views of container 100. FIG. 6A is a cross-sectional view of container 100 from the perspective of plane A-A (FIG. 4A). FIG. 6B is a cross-sectional view of the container 100 from the perspective of plane B-B (FIG. 4B).

As shown in FIGS. 5-6, the back 114 of the container 100 is curved backward, with a convex side contacting the back of an infant placed within the container 100, so that it provides an angled rest for the back of the infant. The curvature of the upper end of the container 10 is substantially straight with a mild incline until about two thirds of the length of the container bottom. At this point, the upper end of the container 100 has a more pronounced upward curvature at an inflection point where the upper surface of the container 100 inclines more dramatically upward toward the back portion 102 of the container 100. The infant need not have to sit up straight and risk falling over frontwards or to the side. The infant can rest her back directly on the angled back 114 of the container in such a way that the back of the baby may be stretched backwards as her legs are stretched forwards over the hump 109, thereby creating a less stressful sitting/lounging position. This relaxed, ergonomic position results in less tension for the infant, and therefore less chances of resistance for the infant during bathing time, and a more pleasant experience for the parent.

As shown in FIGS. 5A and 5B, a lip 118 is constructed so as to be more pronounced at the front portion 101 of the container 100 and is gradually reduced and eventually eliminated as the lip travels toward the back portion 102 of the container 100. At the front portion 101, the lip 118 is configured to be grasped onto by one hand of a user while the handle 108 at the back portion 102 can be grabbed onto by another hand of the user to manipulate and move the container 100 around as desired.

As shown in FIGS. 1A, 3A, 4A, and 6A, support cushions are positioned at various locations in the container 100. A back support cushion 121 lines a substantial portion of the back portion 114 of the container 100 so that the infant's back has a softer surface to contact when the infant is positioned within the container 100. The back support cushion 121 also provides a comfortable surface for the infant thereby making it more likely that the infant will comfortably rest against the back support cushion 121 and allow bathing to proceed without much resistance. The back support cushion 121 extends from about the bottom surface 107 to the back portion 102 of the container 100, and includes the surface of the handle portion 108. This full cover of the inside surface of the back 114 of the container 100 allows for the back of the infant's head and body to always come into contact with the back support cushion 121, even if the back of the infant's head reaches the back portion 102 and handle 108 of the container 100.

The handle portion 108 is an advantage in that it can be used for hanging and storage purposes. The handle portion 108 is beneficial for manipulating the container 100 when it is heavy and full of water. The handle portion 108 can easily be grasped to move the container 100 around with or without an infant disposed within the container 100.

A seat support cushion 122 is positioned in the first open chamber portion 112 of the container 100. This seat support cushion 122 comes into contact with an infant's bottom and provides an added layer of comfort by alleviating the stress of friction which may be caused between an infant's bottom and the bottom portion 107 of the container 100, particularly when the infant moves around within the container 100.

Although an exemplary back support cushion 121 and seat support cushion 122 are shown, other support cushions are also possible and within the purview of the present subject disclosure. For example, further support cushions may be positioned on the central hump 109, the second open chamber portion 113, the right side portion 103 and left side portion 104, or any other portion of the container 100 that may come into contact with the infant. Alternatively, the entire container 100 may be lined with a support cushion to provide the container with a soft, comfortable feel.

As shown in FIGS. 2A, 3A, 5A, and 6A, a series of friction legs 123 may be positioned on the bottom portion of the container 100 to resists any slideability of the container 100 when resting on any surface. The friction legs 123 provide a level of friction to grip onto a surface and prevent an accidental movement of the container 100. The friction legs 123 also provide elevated height to the lower end of the container 100 so that the resilient plug 150 can open and close unimpeded. Likewise, the height of the friction legs 123 allows the resilient plug 150 to be easily opened to allow proper drainage of water collected within the container 100. This is a big advantage over other conventional infant containers which do not have a drain. It is quite difficult to turn over a heavy conventional infant container filled with water. Although six friction legs 123 are shown (see FIG. 2A), any number is possible and within the purview of the present subject disclosure. Alternatively, the entire bottom side of the container 100 may be lined with a friction-causing material to allow greater resistance to movement of the container 100, particularly during use. The material used for the friction legs 123 in this disclosure include, but are not limited to, rubber or other resilient and high-friction plastics or composites.

As shown in FIGS. 1A, 2A, 4A, and 6A, a resilient plug 150 is positioned within a plug aperture 116 located at the bottom 107 of the container 100. The details of the resilient plug 150 and its structure and placement within plug aperture 116 will now be described in detail with respect to FIGS. 7-10. It should be noted that the cross-sectional views shown in FIGS. 7A, 7B, 8A, 9A, 10A, and 10B are from just the plug 150 or immediate surrounding area from the perspective of plane A-A (FIG. 4A), when the plug 150 is in a closed (FIGS. 7A, 8A, 8B, 10A) or open (FIGS. 7B, 9A, 9B, 10B) position.

Figure 1B:
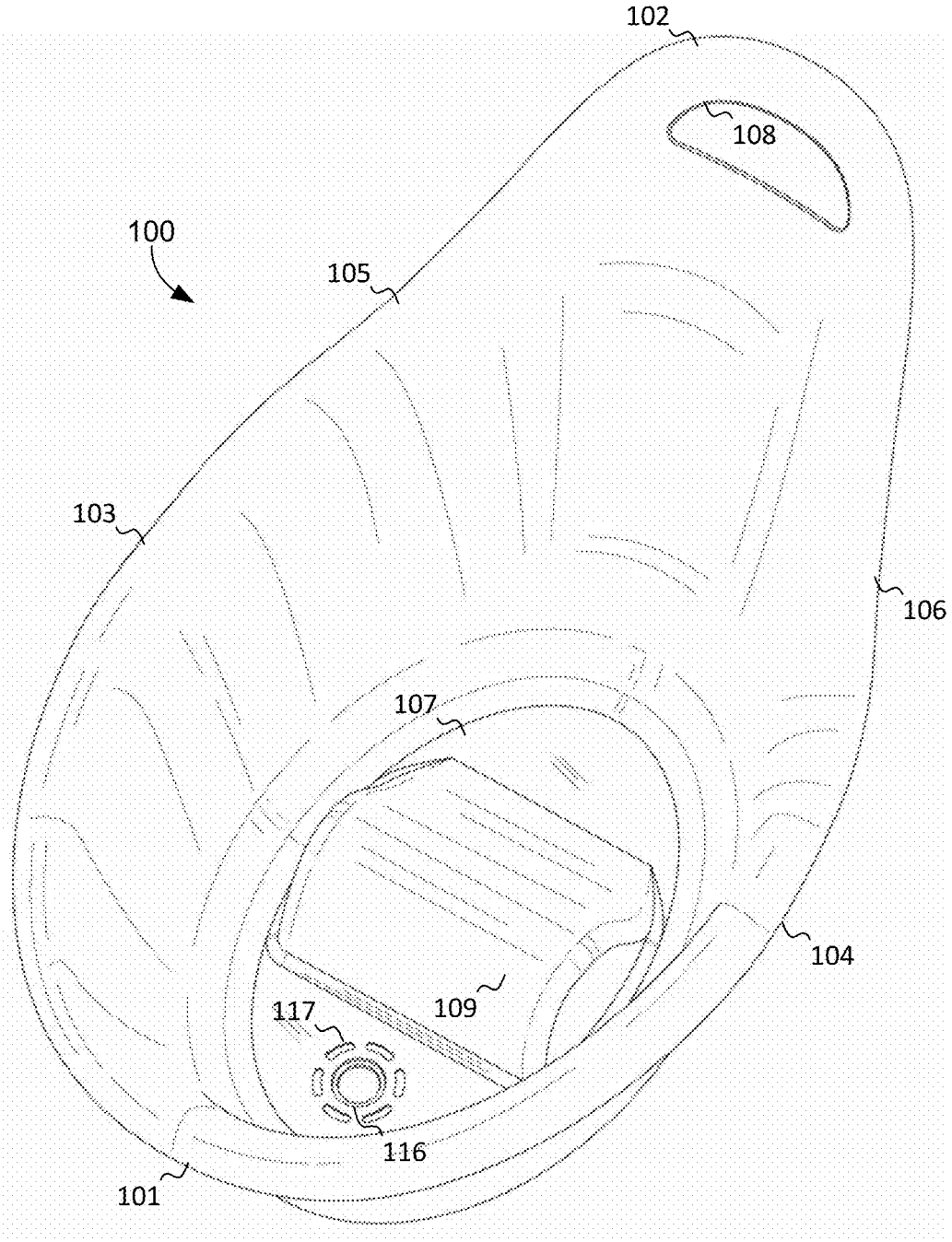
FIG. 1B is a front perspective view of a container without the plug or support padding, according to an exemplary embodiment of the present subject disclosure.
Figure 2A:
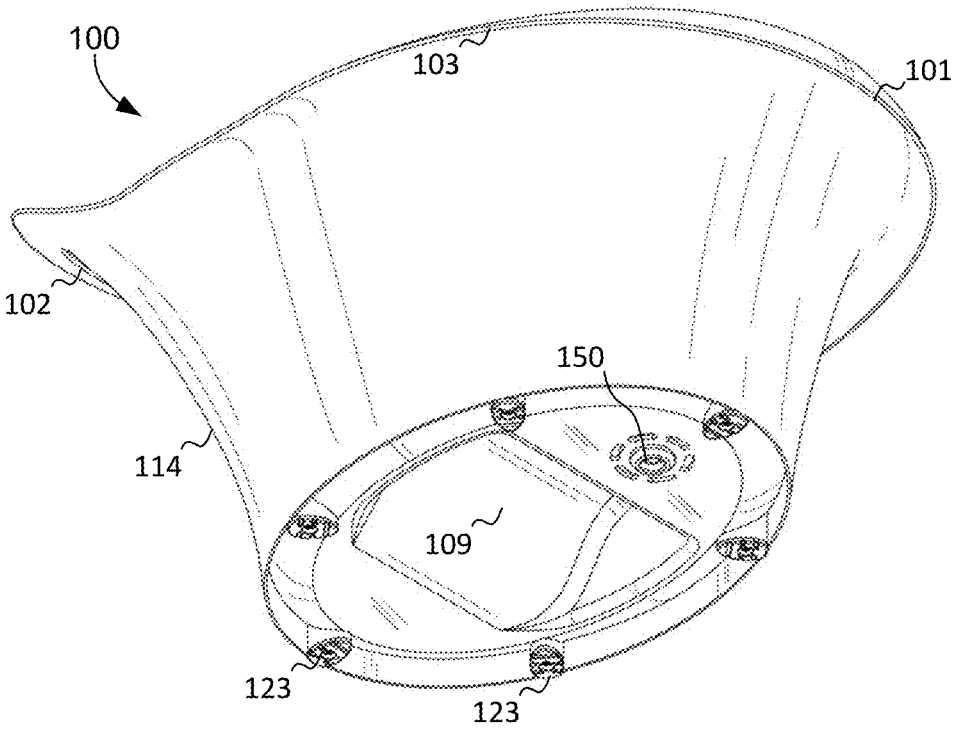
FIG. 2A is a bottom perspective view of a container with plug and leg supports, according to an exemplary embodiment of the present subject disclosure.
Figure 2B:
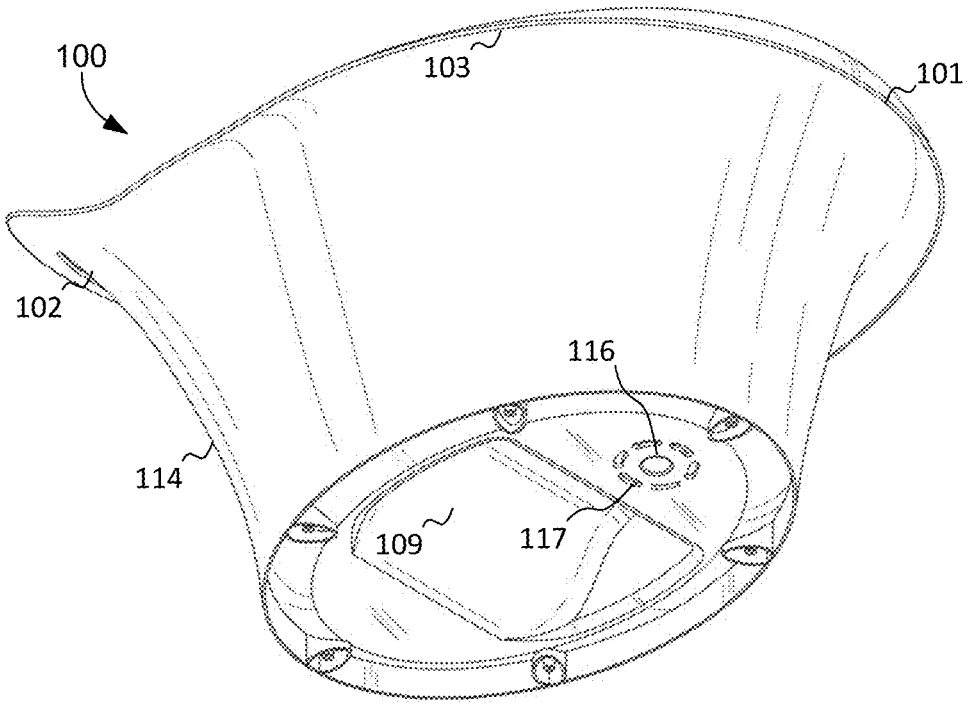
FIG. 2B is a bottom perspective view of a container without the plug or leg supports, according to an exemplary embodiment of the present subject disclosure.
Figure 3A:
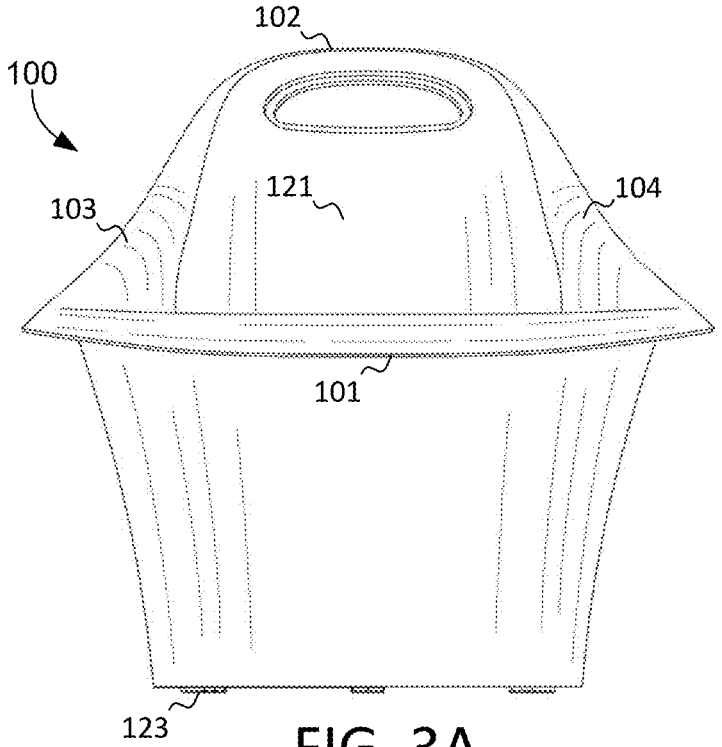
FIG. 3A is a front view of a container with support padding and leg supports, according to an exemplary embodiment of the present subject disclosure.
Figure 3B:
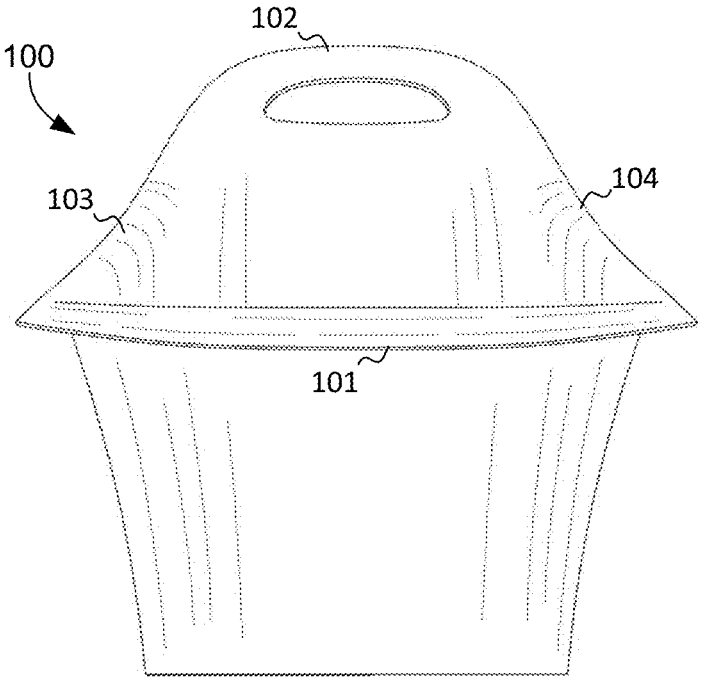
FIG. 3B is a front view of a container without the support padding and leg supports, according to an exemplary embodiment of the present subject disclosure.
Figure 7A:
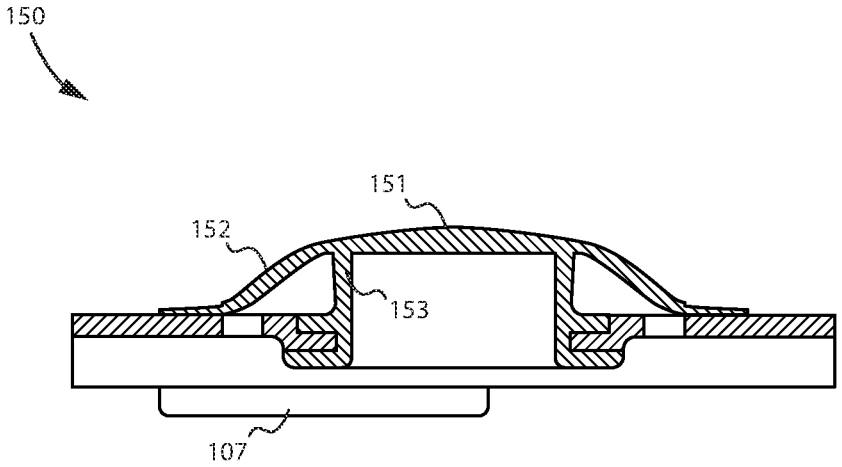
FIG. 7A is a side cross-sectional view of a plug in a closed position, according to an exemplary embodiment of the present subject disclosure.
Figure 7B:
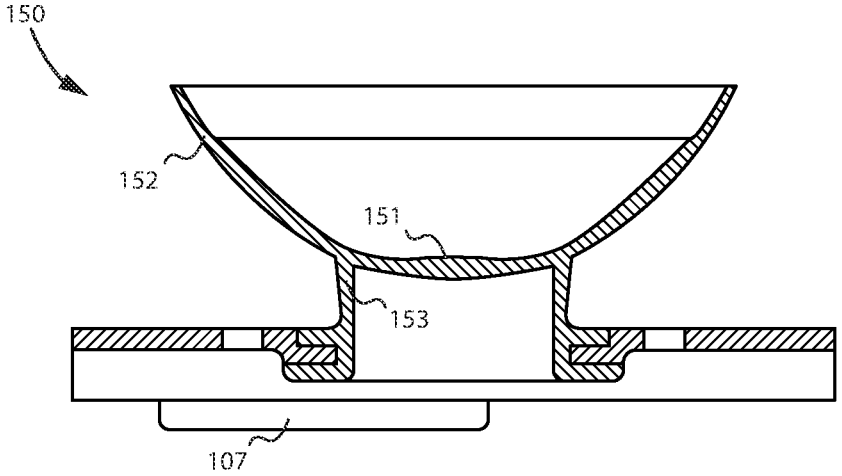
FIG. 7B is a side cross-sectional view of plug in an open position, according to an exemplary embodiment of the present subject disclosure.

As shown in FIGS. 7A-7B, the resilient plug 150 is designed to lock in and rest within the plug aperture 116 of the container 100. The top portion 151 of the plug 150 is shaped like a top of a mushroom (or umbrella) and is central to a resilient surrounding top edge portion 152, which can flap over and cover a series of apertures 117 which constitute the drain of the container 100. The plug aperture 116 and drain apertures 117 are shown in FIGS. 1B, 2B, 4B. The drain apertures 117 are positioned circularly around the central plug aperture 116, where the plug 150 is reversibly affixed in place. Six individual drain apertures 117 are shown in the exemplary embodiments, but any number is possible and within the purview of the present subject disclosure.

As shown in FIGS. 8-8, an extended top portion of the top of the plug 150, in the shape of a protruding tab 159, extends from the top edge portion 152, making it easier to grip and pull back the top edge portion 152 of the plug 150. The pulling of the tab 159 results in the entire top edge portion 152 of the mushroom-like plug 150 to be flipped upwards, similar to an umbrella which has been flipped inside out in a strong wind.

When the top edge portion 152 of the top of the plug 150 is flipped upwards (as in FIG. 9), any fluid within the container 100 can flow down and through the drain apertures 117, thereby draining the container 100. The draining may be stopped at any point by gently pushing down on any portion of the flipped up top edge portion 152 of the plug 150, which would then flip the entire mushroom-like top edge portion 152 back down (as in FIG. 7A, 8A, 8B, 10A), thereby preventing any further draining of fluid from the container 100. The plug 150 may be removed from the plug aperture 116 and inserted back in as needed by fitting the corresponding adjacent flanges 154, 155 of the plug 150 into the plug aperture 116, as will be described in more detail below. The junction between the surrounding top edge portion 152 and the top edge portion 151 is constructed slightly thinner to allow the top edge portion 152 to pivot relative to the top portion 151 during opening and closing of the resilient plug 150.

Figure 8A:
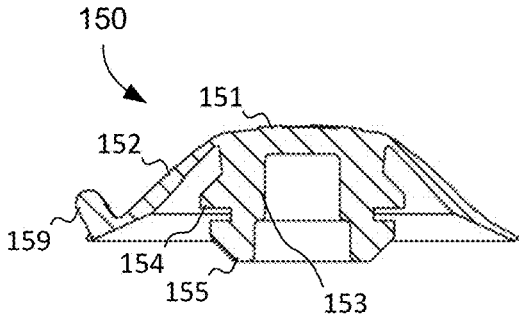
FIG. 8A is a side cross-sectional view of a plug in a closed position, according to an exemplary embodiment of the present subject disclosure.
Figure 8B:
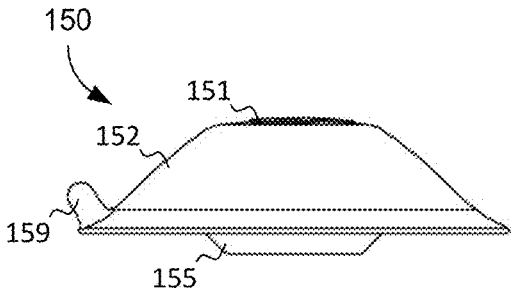
FIG. 8B is a side view of plug in a closed position, according to an exemplary embodiment of the present subject disclosure.
Figure 9A:
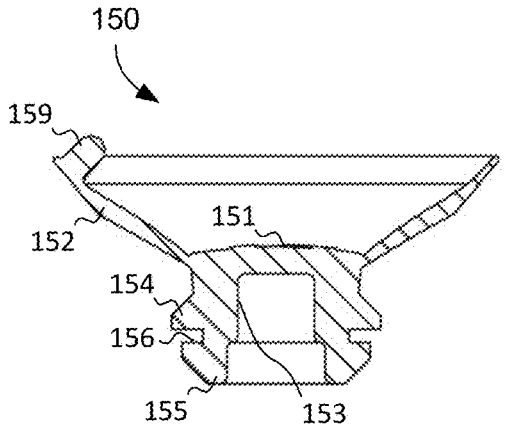
FIG. 9A is a side cross-sectional view of a plug in an open position, according to an exemplary embodiment of the present subject disclosure.
Figure 9B:
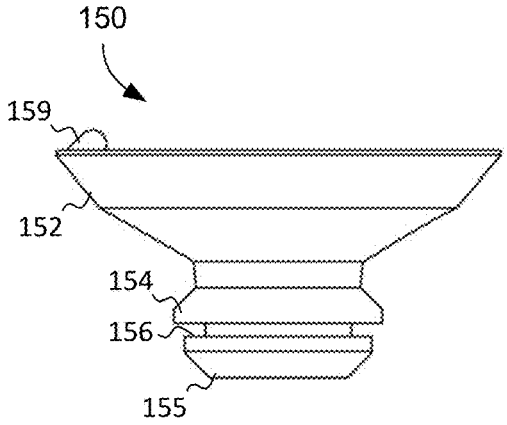
FIG. 9B is a side view of plug in an open position, according to an exemplary embodiment of the present subject disclosure.
Figure 10A:
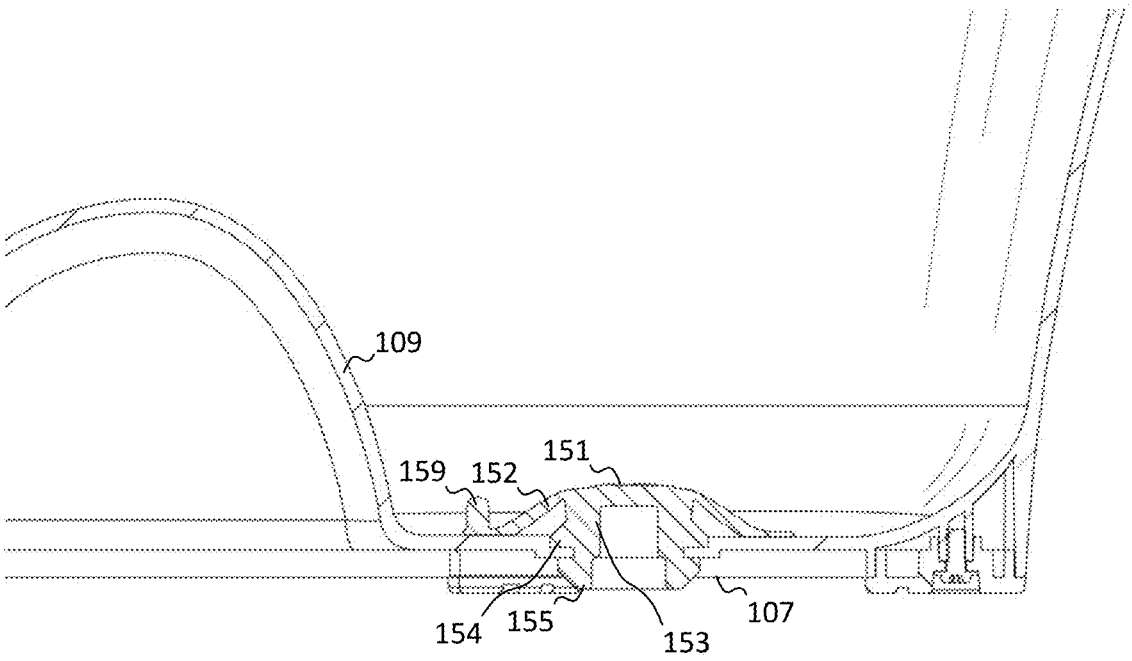
FIG. 10A is a side cross-sectional view of a plug in a closed position within a container, according to an exemplary embodiment of the present subject disclosure.
Figure 10B:
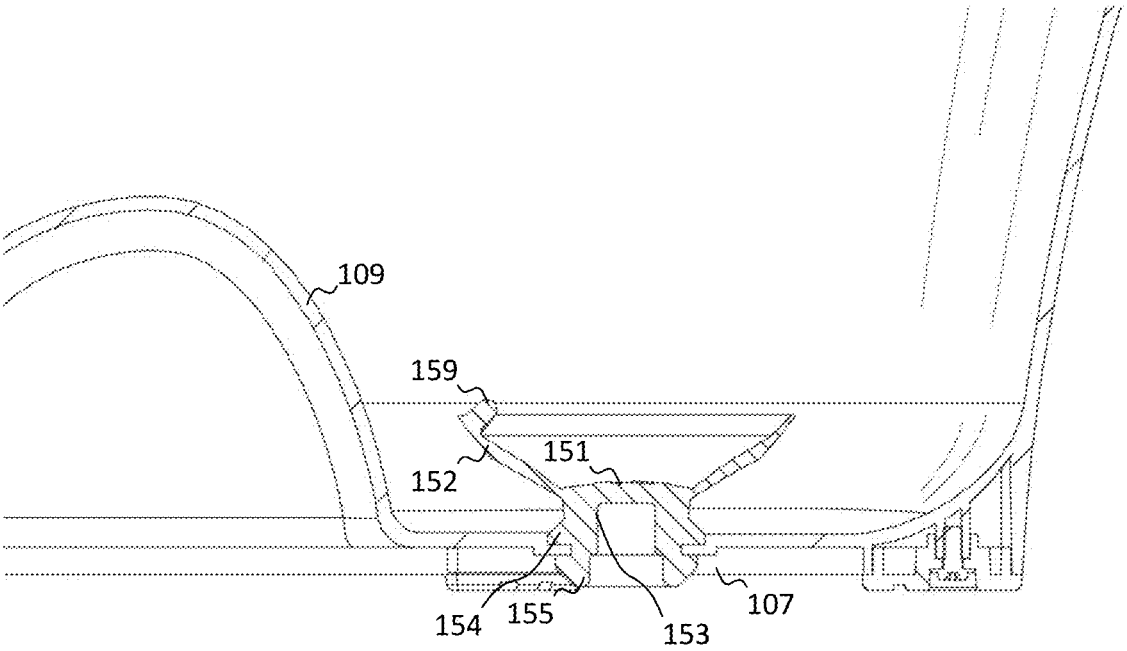
FIG. 10B is a side cross-sectional view of plug in an open position within a container, according to an exemplary embodiment of the present subject disclosure.

As shown in FIGS. 8A, 9A, and 9B, the plug 150 has a central top portion 151, and a surrounding top edge portion 152. The top edge portion 151 remains relatively stationary during the closed (FIGS. 7A, 8, 10A), and open (FIGS. 7B, 9, 10B) positions of plug 150. The surrounding top edge portion 152 is the only portion of the plug 150 which moves between the open and closed plug positions. An internal vertical wall 153 provides internal structural stability to the plug 150 during the open and closed positions. A top flange 154 and bottom flange 155 protrude from a recessed portion 156 and serve to secure the plug 150 structure within the plug aperture 116. When in place in the plug aperture 116, the top flange 154 is positioned on top of the plug aperture 116 and the bottom flange is positioned on the bottom of the plug aperture 116 such that the entirety of the plug aperture 116 is plugged by the recess 156 area of the plug 150. The material used to construct the top flange 154 and bottom flange 155 have enough resilience to be able to pushed into the plug aperture 116 with some applied pressure from a user's fingers for purposes of inserting or removing the plug 150 from the plug aperture 116. Likewise, the top flange 154 is somewhat wider than the bottom flange 155 to prevent the top flange 154 portion of the resilient plug 150 from being pushed through the plug aperture 116 after the chamfered portion on a lower end of the bottom flange 155 has been pushed through the plug aperture 116. The thinnest and/or most resilient portion of the plug 150 is the top edge portion 152 because of the need to pull up and down to uncover and cover the drain holes 117, respectively. The surrounding top edge portion 152 has a stepped ridge which allows the surrounding top edge portion 152 to be flattened more easily in the closed position.

The various components described herein, for example, the container body and support material, may be composed of metal, plastic, rubber, composite, or any other material which would be suitable for this subject disclosure. Further, the container is not limited for soaking and washing infants but may be used for washing small children, animals, or any other uses which would benefit from a controlled washing within a container.

As employed in this specification and annexed drawings, the term "or" is intended to mean an inclusive "or" rather than an exclusive "or." Moreover, articles "a" and "an" as used in the subject specification and annexed drawings should generally be construed to mean "one or more" unless specified otherwise or clear from context to be directed to a singular form.

What has been described above includes examples that provide advantages of the subject disclosure. It is, of course, not possible to describe every conceivable combination of components or methodologies for purposes of describing the subject disclosure, but one of ordinary skill in the art may recognize that many further combinations and permutations of the claimed subject matter are possible. Furthermore, to the extent that the terms "includes," "has," "possesses," and the like are used in the detailed description, claims, appendices and drawings such terms are intended to be inclusive in a manner similar to the term "comprising" as "comprising" is interpreted when employed as a transitional word in a claim.

The illustrations and examples provided herein are for explanatory purposes and are not intended to limit the scope of the appended claims. It will be recognized by those skilled in the art that changes or modifications may be made to the above described embodiment without departing from the broad inventive concepts of the subject disclosure. It is understood therefore that the subject disclosure is not limited to the particular embodiment which is described, but is intended to cover all modifications and changes within the scope and spirit of the subject disclosure.

What is claimed is:

1. A container, comprising:

a base portion having a single plane;

a wall portion positioned on the base portion and having a back portion, the back portion being entirely curved from a bottom end of the back portion connected to the base portion to a top end of the back portion, the entire curve of the back portion being such that it is convex adjacent an interior of the container, the wall portion further having an upper end that is substantially straight with a first incline from a front portion of the wall portion towards the back portion for about two thirds of the entire length of the container, and the upper end having a curved, second incline that is greater than the first incline for the other third of the length of the container leading to the back portion;

a hump positioned on the base portion and having an outer edge which is defined by its protrusion from the base portion, wherein a channel is formed between the outer edge of the hump and the wall portion such that a top of the base portion is continuously planar around the entire outer edge of the hump and is parallel to a surface on which the container is placed; and a plug positioned within a plug aperture in the base portion, wherein the plug is mushroom-shaped with a resilient top portion that covers drain apertures in the base portion, and wherein the resilient top portion of the plug has a central portion that remains in a fixed position at all times with respect to the plug aperture, and an edge portion that is adapted to flip up to allow fluid to pass through the drain apertures, and to flip down to cover the drain apertures and prevent fluid from passing through the drain apertures.

2. The container of claim 1, wherein the back portion has a height that is higher than other heights of the wall portion.

3. The container of claim 2, wherein the hack portion includes a handle.

4. The container of claim 1, wherein the hump is asymmetrical.

5. The container of claim 4, wherein the hump is concave on a first side and convex on a second side.

6. The container of claim 5, wherein the concave side of the hump faces a convex side of the back portion.

7. The container of claim 5, wherein the convex side of the hump faces away from the convex side of the back portion.

8. The container of claim 1, wherein the hump divides the base portion into two open chamber portions, a first open chamber portion positioned between the hump and the back portion, and a second open chamber portion positioned between the hump and a side opposite of the back portion.

9. The container of claim 8, wherein the plug is positioned in the second open chamber portion.

10. The container of claim 9, wherein that covers the drain apertures are located in the second open chamber portion.

11. The container of claim 10, wherein the resilient top portion of the plug is adapted to flip up to allow fluid in the second open chamber portion to pass through the drain apertures, and to flip down to cover the drain apertures and prevent fluid from passing through the drain apertures.

12. The container of claim 11, wherein the plug is removable from the plug aperture.

13. The container of claim 11, wherein the drain apertures are positioned circularly around the plug aperture.

14. A container, comprising a base portion having a single plane;

a wall portion positioned on the base portion and having a back portion, the back portion being entirely curved from a bottom end of the back portion connected to the base portion to a top end of the back portion, the entire curve of the back portion being such that it is convex adjacent an interior of the container, the wall portion further having an upper end that is substantially straight with a first incline from a front portion of the wall portion towards the back portion for about two thirds of the entire length of the container, and the upper end having a curved, second incline that is greater than the first incline for the other third of the length of the container leading to the back portion;

an asymmetric hump positioned on the base portion and having an outer edge which is defined by its protrusion from the base portion, wherein a channel is formed between the outer edge of the hump and the wall portion such that a top of the base portion is continuously planar around the entire outer edge of the hump and is parallel to a surface on which the container is placed; and a plug positioned within a plug aperture in the base portion, wherein the plug is mushroom-shaped with a resilient top portion that covers drain apertures in the base portion, and wherein the resilient top portion of the plug has a central portion that remains in a fixed position at all times with respect to the plug aperture, and an edge portion that is adapted to flip up to allow fluid to pass through the drain apertures, and to flip do to cover the drain apertures and prevent fluid from passing through the drain apertures.

15. The container of claim 14, further comprising a protruding tab positioned on the top portion of the plug.

16. A container, comprising a base portion having a single plane;

a wall portion positioned on the base portion and having a back portion, the back portion being entirely curved from a bottom end of the back portion connected to the base portion to a top end of the back portion, the entire curve of the back portion being such that it is convex adjacent an interior of the container, the wall portion further having an upper end that is substantially straight with a first incline from a front portion of the wall portion towards the back portion for about two thirds of the entire length of the container, and the upper end having a curved, second incline that is greater than the first incline for the other third of the length of the container leading to the back portion;

an asymmetric hump positioned on the base portion, wherein the hump divides the base portion into two open chamber portions, a first open chamber portion positioned between the hump and the back portion, and a second open chamber portion positioned between the hump and a side opposite of the back portion, the hump having an outer edge which is defined by its protrusion from the base portion, wherein a channel is formed between the outer edge of the hump and the wall portion such that a top of the base portion is continuously planar around the entire outer edge of the hump and is parallel to a surface on which the container is placed; and a plug positioned within a plug aperture in the base portion, wherein the plug is mushroom-shaped with a resilient top portion that covers drain apertures in the base portion, and wherein the resilient top portion of the plug has a central portion that remains in a fixed position at all times with respect to the plug aperture, and an edge portion that is adapted to flip up to allow fluid to pass through the drain apertures and to flip down to cover the drain apertures and prevent fluid from passing through the drain apertures.

17. The container of claim 16, wherein the hump is concave on one side and convex on an adjacent side.

18. The container of claim 17, wherein the concave side of the hump faces the convex side of the back portion.

* * * * *